US007556053B2

(12) United States Patent
Hansen

(10) Patent No.: US 7,556,053 B2
(45) Date of Patent: Jul. 7, 2009

(54) SUPPORTING DEVICE

(75) Inventor: Guttorm Hansen, Finnsnes (NO)

(73) Assignee: Mitra AS, Finnsnes (NO)

( * ) Notice: Subject to any disclaimer, the term of this patent is extended or adjusted under 35 U.S.C. 154(b) by 64 days.

(21) Appl. No.: 11/791,900

(22) PCT Filed: Nov. 30, 2005

(86) PCT No.: PCT/NO2005/000443

§ 371 (c)(1),
(2), (4) Date: May 30, 2007

(87) PCT Pub. No.: WO2006/059909

PCT Pub. Date: Jun. 8, 2006

(65) Prior Publication Data

US 2008/0023609 A1 Jan. 31, 2008

(30) Foreign Application Priority Data

Dec. 3, 2004 (NO) ..... 20045314

(51) Int. Cl.
*E04H 15/60* (2006.01)

(52) U.S. Cl. ..... 135/114; 135/98; 211/1.3; 211/197

(58) Field of Classification Search ..... 135/114, 135/25.41, 98, 99, 22, 23; 248/188.1, 188, 248/7, 146, 158; 211/1.2, 195, 196, 197, 211/172, 85.243
See application file for complete search history.

(56) References Cited

U.S. PATENT DOCUMENTS 3,167,081 A 1/1965 Higgins
3,435,836 A * 4/1969 Vanzini ..... 135/22
3,534,752 A * 10/1970 Vanzini ..... 135/22
3,709,238 A * 1/1973 Leopoldi et al. ..... 135/15.1
3,866,619 A 2/1975 Per Frisk
4,084,600 A * 4/1978 dePolo ..... 135/15.1
4,259,974 A * 4/1981 de Polo ..... 135/24
4,441,518 A 4/1984 Hogan et al.
4,637,415 A 1/1987 Dalo et al.
4,788,996 A * 12/1988 Forshee ..... 135/16
4,842,003 A * 6/1989 Baldwin et al. ..... 135/19.5
4,966,179 A * 10/1990 Baldwin et al. ..... 135/19.5
5,002,082 A 3/1991 Röder
6,273,111 B1 * 8/2001 Weiss et al. ..... 135/25.41

FOREIGN PATENT DOCUMENTS

| | | |
|---|---|---|
| FR | 2 557 909 | 1/1894 |
| GB | 2326221 | 12/1998 |
| NL | 9100259 | 9/1992 |

* cited by examiner

*Primary Examiner*—David Dunn
*Assistant Examiner*—Noah Chandler Hawk
(74) *Attorney, Agent, or Firm*—Merchant & Gould P.C.

(57) ABSTRACT

A supporting device for supporting a cloth element, for example a camouflage net. The supporting device (1) comprises a hollow rod (4), at least one supporting element (12) and an attachment device (50). The supporting element (12) is attached at a proximal end (16) to the attachment device (50). The supporting element (12) can assume the following positions:—a first, retracted position where the supporting element (12) is at least partly mounted inside the hollow rod (4), and—a second, extended position where a distal end (18) of the supporting element (12) is arranged at a distance out from the central longitudinal axis of the hollow rod (4).

8 Claims, 8 Drawing Sheets

SUPPORTING DEVICE

The present invention relates to a supporting device for supporting a cloth element, for example a camouflage net for camouflaging military vehicles or the like.

When a vehicle has to be camouflaged, there is a need for devices that hold the camouflage net up at a distance away from the vehicle. For other areas of application there is also a need for devices that hold up a cloth material, net or the like, thereby providing space under the cloth or the net. In existing net supports, use is often made of saplings felled in the forest. The saplings represent a simple, but rather primitive solution. There are a couple of problems associated with the saplings, the first being that there are no devices on top of the saplings to hold the cloth out over a slightly larger area, with the result that the cloth support is sharply pointed with no rounding of the support point. A second problem area is that the saplings are not collapsible, which means that they have to be stored and transported at the actual length required for the support. The saplings are often lashed to the vehicle and have occasionally come loose, representing a traffic risk.

As an alternative to the saplings, telescopic glass fibre net supports have been developed, with a separate top solution in the form of solid loop elements which are folded down along the rod for transport. This provides easier transport as they are telescopic, but the loop elements have a tendency to become entangled in things. According to Defence reports, the glass fibre supports are very expensive to purchase and easily broken, especially in cold weather. A further drawback is that the top takes up a relatively large amount of space when packed. This is therefore not a good solution either to the problem of supporting a cloth element when it has to be transported.

Another disadvantage of the prior art is that the supporting device has to be mounted and dismantled in several parts, and it can be difficult to find these parts again in darkness and snow.

It is therefore an object of the present invention to provide a supporting device which is an improvement compared to known solutions. It is also an object to provide a supporting device that occupies little space in a transport position and is easy to transport. It is a further object to provide a supporting device that provides support to a cloth element over a larger area. It is also an object to provide a supporting device where all parts are arranged as a unit and where mounting and dismantling are performed without the risk of losing parts of the supporting device. It is yet another object to provide a supporting device that is easy to use. An additional object is to provide a supporting device that is cheap to produce while being robust and having few wear parts.

The above-mentioned objects are achieved by a supporting device as indicated in the following patent claims.

The cloth element may be a camouflage net, but it is also conceivable for the supporting device to be employed for supporting other types of cloth elements such as tents, nets or the like.

The invention will now be explained in greater detail with a non-limiting embodiment with reference to the attached drawings in which.

Figure 1:
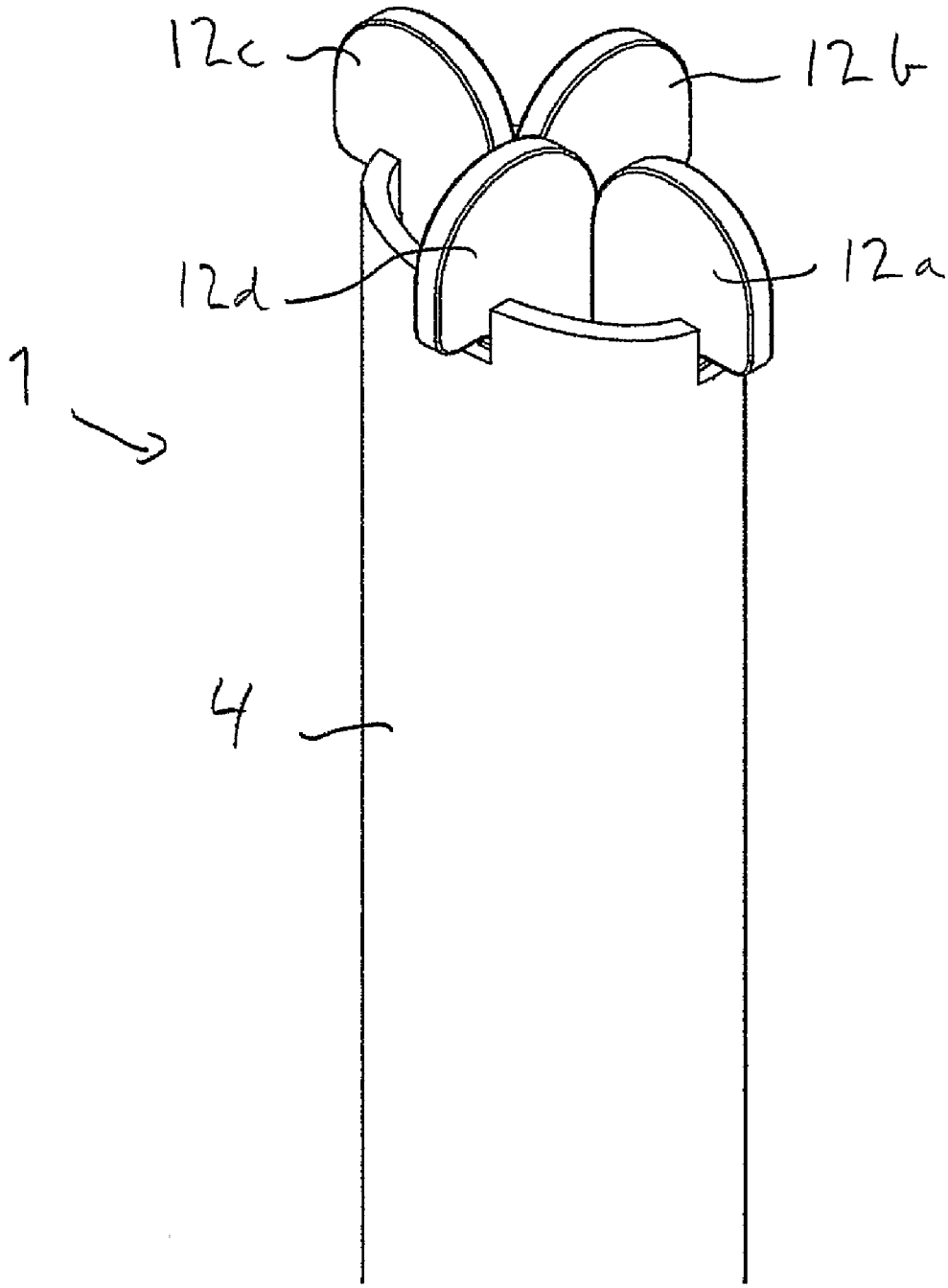
FIG. 1 illustrates the upper end of the supporting device where the supporting elements are in a retracted position in a hollow rod.

FIG. 1 illustrates an upper end of a preferred embodiment of a supporting device 1 in a first, retracted position. The supporting device 1 comprises a preferably oval, hollow rod 4, in one end of which are placed four supporting elements 12*a-d*. The supporting elements 12 are attached to the hollow rod 4 by means of an attachment device 50, which in FIG. 1 is concealed inside the hollow rod 4.

In the lower end of the supporting device 1 there is preferably provided a pointed or similarly shaped end device which enables the rod 4 to be stuck into a base such as earth or snow. The rod 4 may of course also be adapted to be attached to a stand on a vehicle or the like. Furthermore, the rod 4 may preferably be extended in a simple manner, for example by the rod being made telescopic, i.e. comprising elements that can be pushed into and pulled out of one another. This will not be described in greater detail here.

Figure 8:
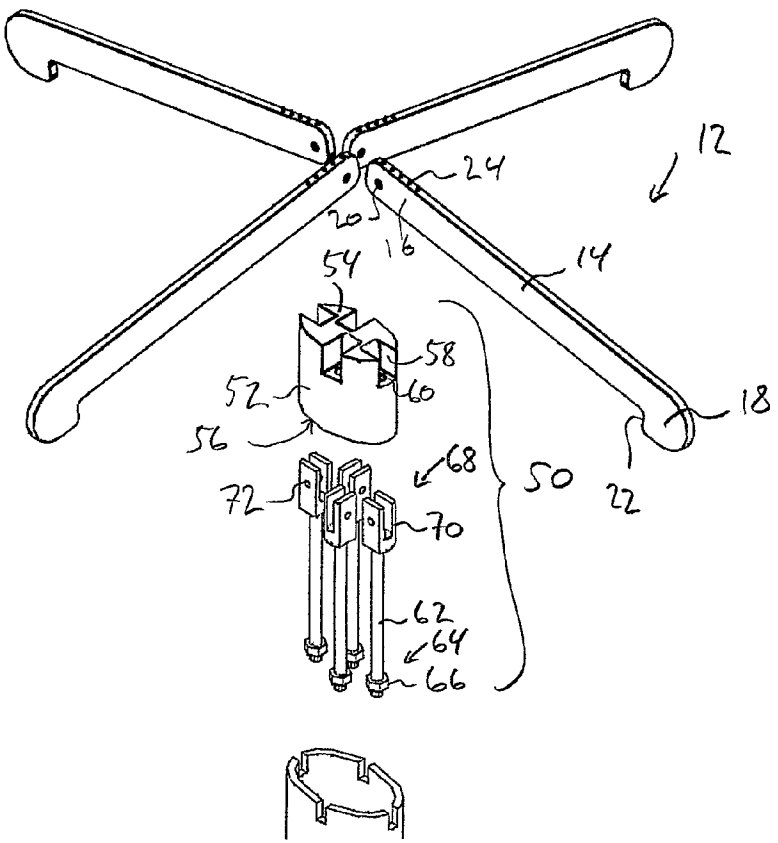
FIG. 8 is an exploded view of the supporting elements and the attachment device for the supporting elements.

The supporting elements and the attachment device will now be described in detail with reference to FIG. 8, which illustrates the individual parts of the supporting device 1.

The supporting element 12 comprises an elongated body 14 with a proximal end 16 and a distal end 18. Both the ends 16, 18 are substantially curved in shape. In the proximal end 16 there is provided an opening 20 for rotatable attachment of the supporting element 12 to the attachment device 50 about the opening 20. The distal end 18 further comprises an edge 22. In an area near the proximal end 16 there are provided friction knobs 24, which ensure that the cloth element does not slide off the supporting device.

Figure 6:
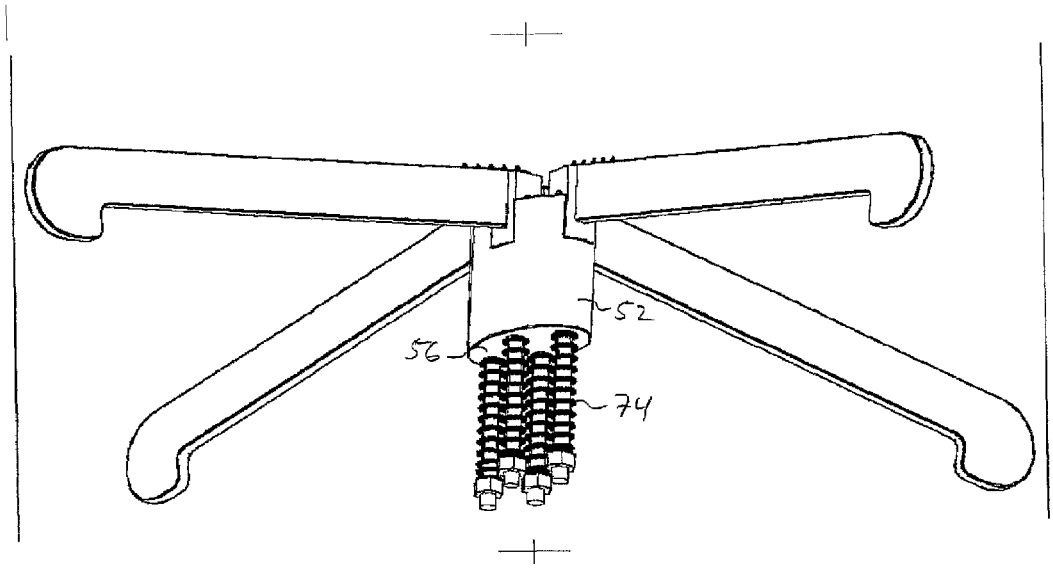
FIG. 6 is a perspective view of FIG. 5 viewed from below.
Figure 7:
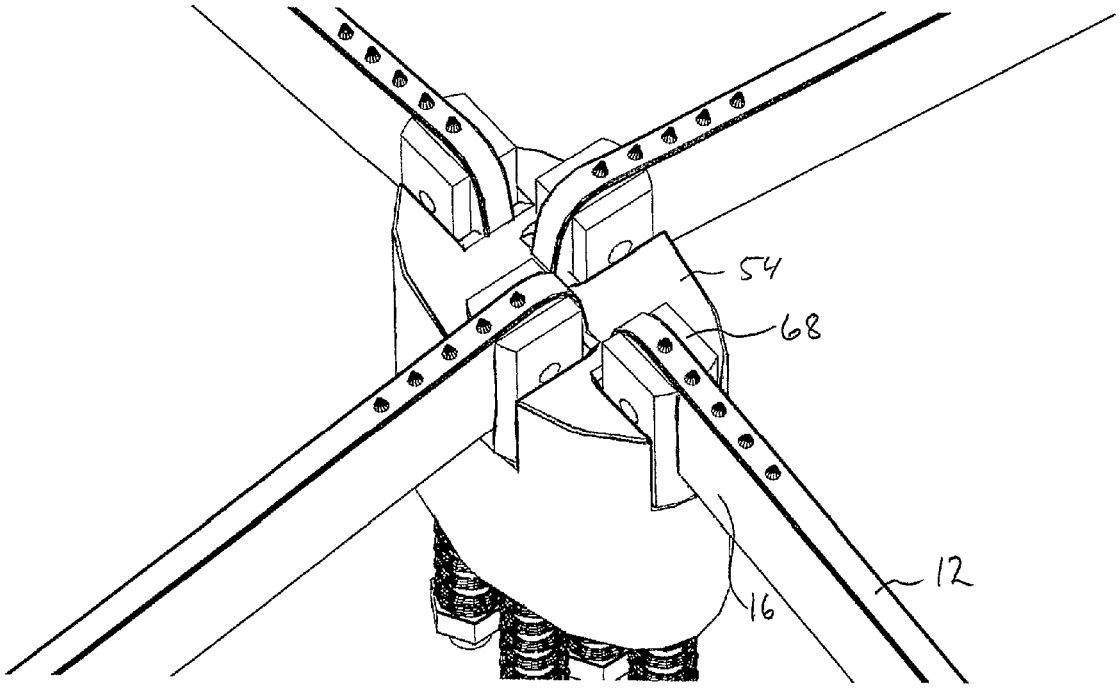
FIG. 7 illustrates an enlarged section of FIG. 5.

The attachment device 50 will now be described in detail, with reference to FIGS. 6, 7 and 8. The attachment device 50 comprises a substantially oval housing 52, with a shape suitable for mounting inside the hollow rod 4 in such a manner that the housing 52 can slide in the longitudinal direction of the hollow rod 4.

The housing 52 has an outer surface 54 facing the opening in the hollow rod 4, and a substantially flat inner surface 56 facing the internal cavity in the hollow rod 4. In the outer surface 54 there are provided four cut-outs 58 (see FIG. 8), where a lead- through opening 60 is provided in each cut-out 58. The lead-through opening 60 is preferably parallel to the longitudinal axis of the hollow rod 4.

A fastening bolt 62 is inserted through each lead-through opening 60. The fastening bolt 62 has a first threaded end 64 with a first spring limiter 66 and a second, preferably U-shaped end 68. In the embodiment the spring limiter 66 is a lock nut screwed to the threaded end 64. The U-shaped end 68 therefore has a slot 70 in it, adapted to receive the proximal end 16 of a supporting element 12. Furthermore, the U-shaped end 68 comprises two opposite openings 72, in such a manner that the fastening bolt 62 can be rotatably attached to the opening 20 in the supporting element 12 by means of a non-illustrated attachment device.

It should be noted that the fastening bolt's 62 first end 64 protrudes from the flat, lower surface 56 of the housing 52, while the fastening bolt's 62 second end 68 is placed in the cut-out 58 in the flat, outer surface 54. This is illustrated in more detail in FIG. 7.

Between the first spring limiter 66 and the flat lower surface 56 a spring 74 is mounted. The flat lower surface 56 consequently constitutes a second spring limiter and this second spring limiter will be common to all four springs. This is illustrated in more detail in FIG. 6.

At the end of the hollow rod 4 which is illustrated in FIGS. 1-4, four cut-outs 6 are provided, adapted to receive the supporting elements. Furthermore, on the inside of the hollow rod 4 a collar device is mounted. The collar device ensures that the attachment device 50 does not side out of the hollow rod 4. Moreover, the edge 22 in the distal end 18 will prevent the supporting elements from sliding down in the hollow rod 4 (see FIG. 1)

The use of the supporting device will now be described with reference to FIGS. 1-4.

We refer to FIGS. 1 which illustrates the supporting device in the first, retracted position. Here the edge 22 of the distal end 18 in each supporting element abuts against its respective cut-out 6 at the end of the hollow rod 4. Furthermore, the curved, proximal end 16 of the supporting element abuts against a curved area of the cut-out 58 in the housing 52. This causes the supporting element 12 to push the housing 52 axially downwards, i.e. in the direction away from the distal end of the supporting element. As a result of this the spring will be tightened and the proximal end of the supporting element will be forced radially outwards against the inside of the hollow rod.

Figure 2:
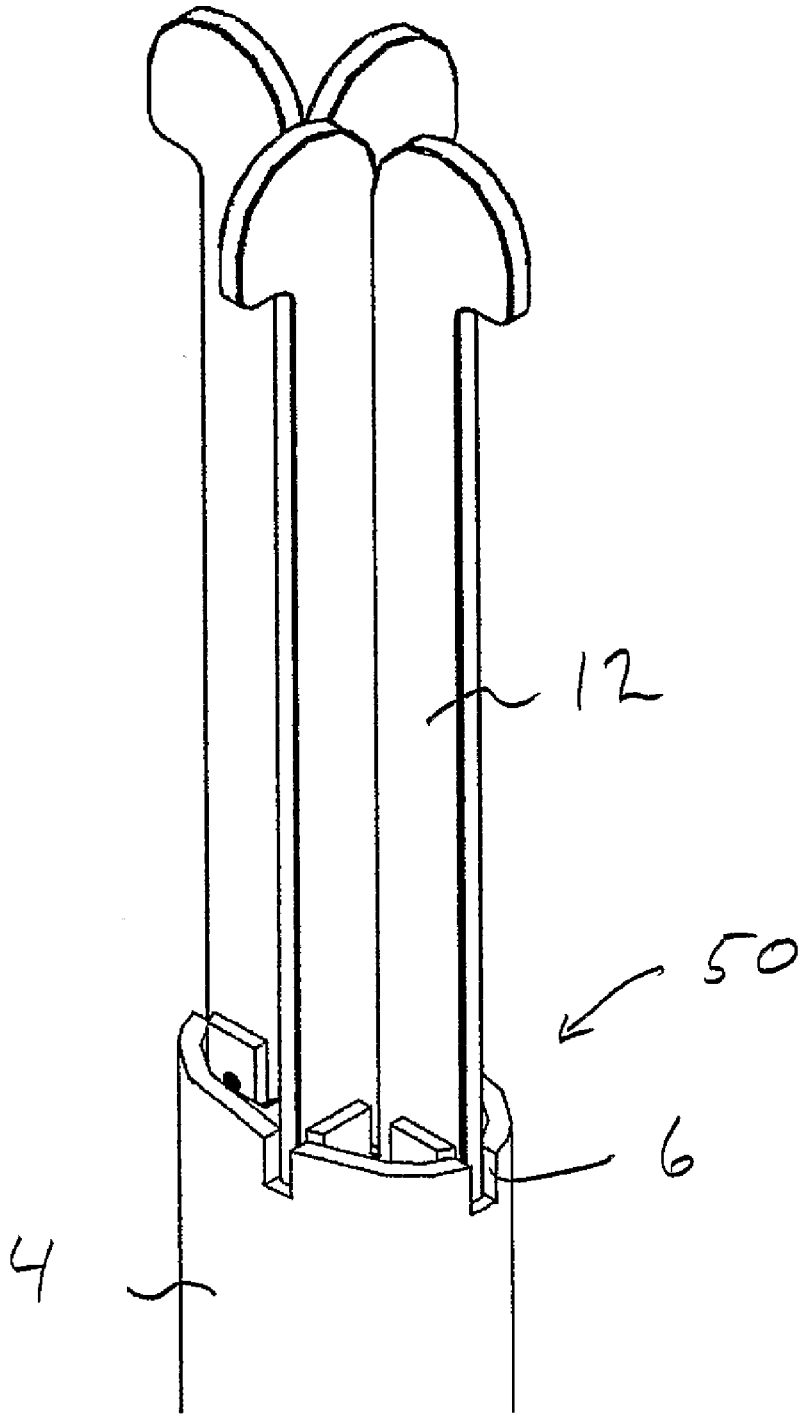
FIG. 2 shows how the supporting elements can be pulled out of the hollow rod.

FIG. 2 shows the supporting elements 12 pulled out in the direction of the longitudinal axis of the rod 4. Parts of the attachment device 50 can just be seen here. This pull-out is a simple operation performed by a simple movement. It should be noted that in this position the springs provide a force that pushes the supporting elements radially outwards, as mentioned above.

Figure 3:
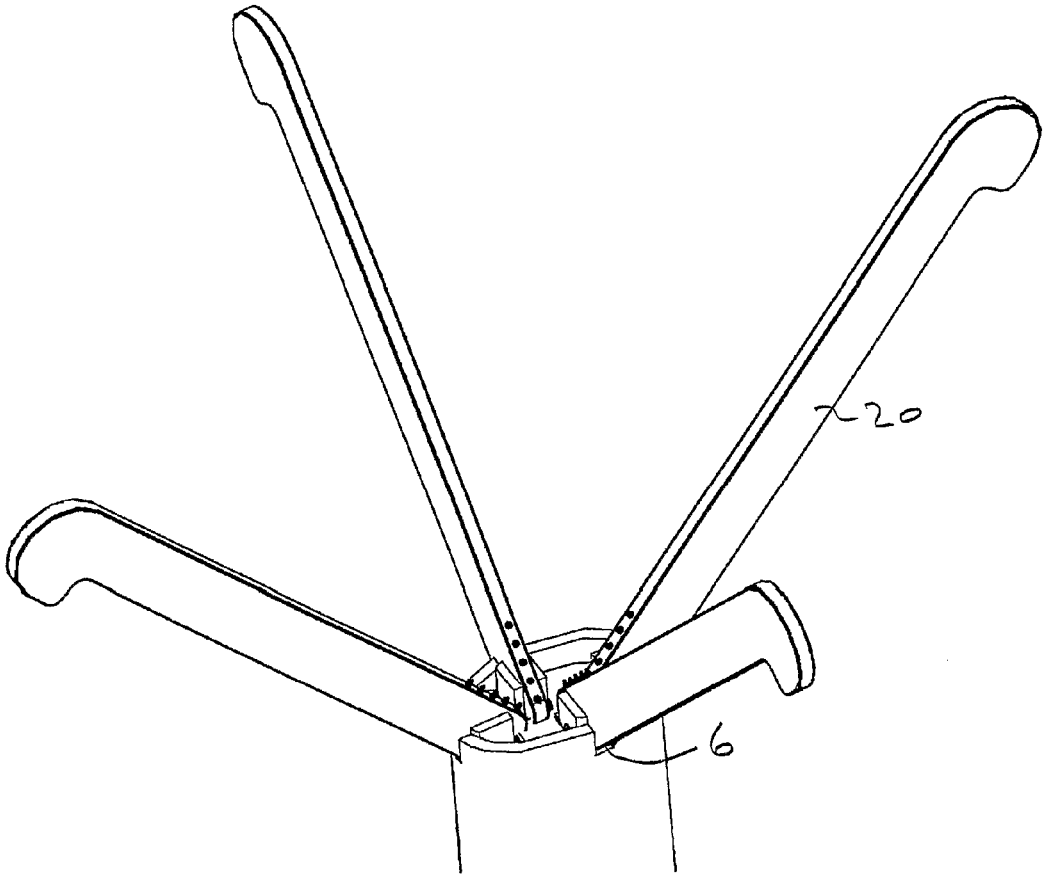
FIG. 3 shows how the supporting elements can be folded out from the longitudinal axis of the hollow rod.

FIG. 3 shows the supporting elements 12 in a position between the first, retracted position and the second, extended position. Note that the supporting elements 20 slide along the cut-out 6.

Figure 4:
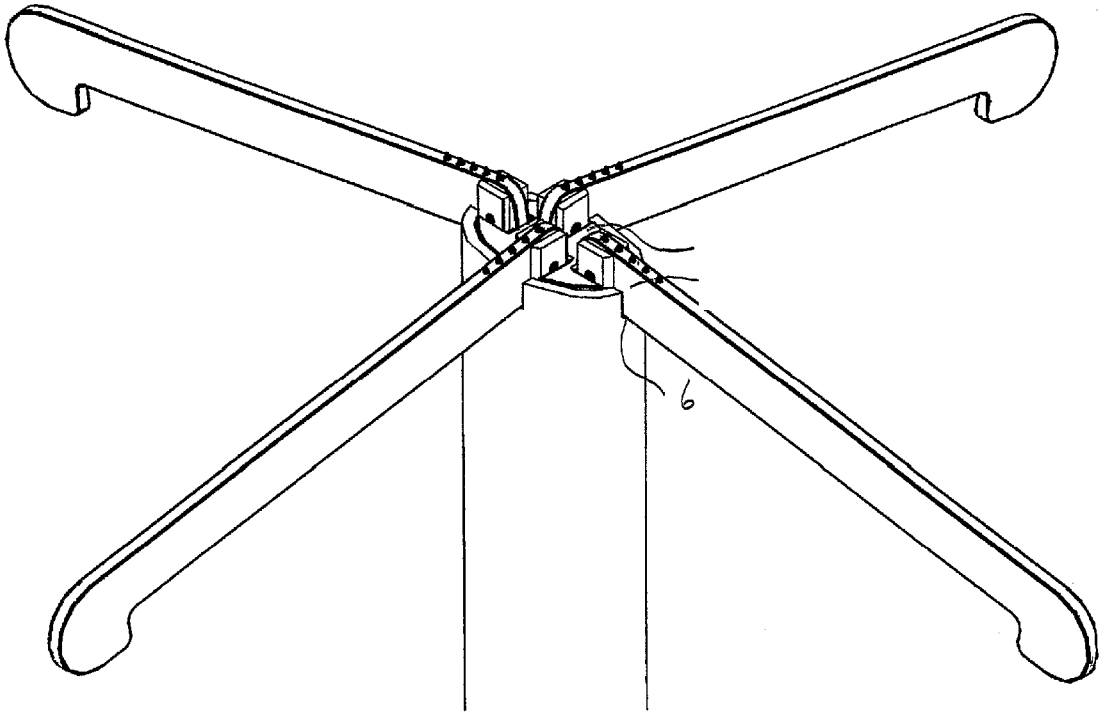
FIG. 4 illustrates the supporting elements in an extended position.
Figure 5:
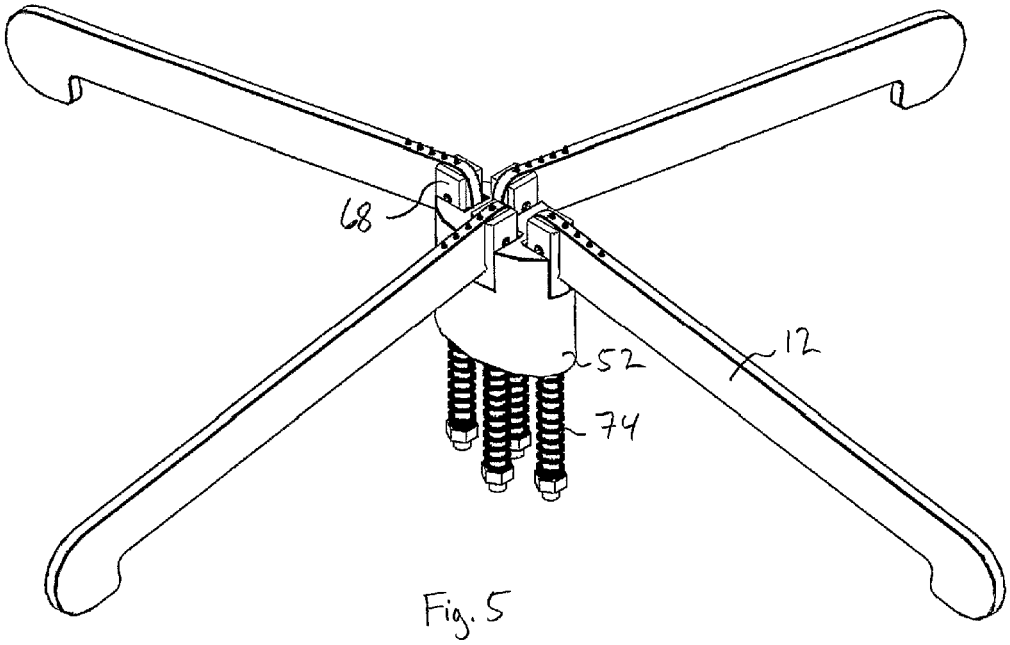
FIG. 5 is a perspective view from above of the supporting elements and the attachment device for the supporting elements.

FIGS. 4 illustrates the supporting elements 12 in the second, extended position. Note that this position is only achieved if the supporting elements are loaded, as would be the case if, for example, the supporting device was supporting a snow-loaded cloth element. In this position the outer, flat surface 54 of the housing 52 abuts against the internal collar in the hollow rod, while the proximal end 16 of the supporting element is pressed against the cut-out 6. This provides a moment, which pulls the fastening bolt 68 axially upwards, i.e. in the direction outwards from the opening in the hollow rod 4. As a result of this, the spring will be tightened.

In the embodiment described above there is a third position between the first and the second positions. As in the case of the second, extended position described above, here too the outer, flat surface 54 of the housing 52 abuts against the internal collar 8 in the hollow rod, while the proximal end 16 of the supporting element is pressed against the cut-out 6. However, in the third position the fastening bolt 68 is not pushed axially upwards.

Since the rod 4 is oval, it will provide support for a cloth element in a more stable manner, since rotation will not occur so easily. Furthermore, rotation of the housing 52 inside the rod 4 is avoided. The hollow rod 4 can of course also be square, polygonal or of another shape that prevents the attachment device 50 from rotating inside the rod.

The supporting device may be made entirely of plastic by means of extrusion and moulding, except for the springs which naturally must be made of metal. This makes the supporting device light and easy to handle.

Furthermore the outer surface 54 also provides an obstacle that prevents dirt, snow, etc. from penetrating into the hollow rod.

In the preferred embodiment described, the supporting device has four supporting elements. It will of course be possible to equip the supporting device with fewer or more supporting elements. It should be noted that since each fastening bolt has separate springs, each supporting element will be independently sprung.

The above detailed description is presented with the particular intention of illustrating and describing advantageous embodiments of the invention. The description, however, in no way limits the invention to the specific embodiments described in detail.

Further modifications and variations will be obvious to a person skilled in the art in light of the above description. The scope of the invention will be apparent from the following patent claims and their equivalents.

The invention claimed is:

1. A supporting device for supporting a cloth element, wherein the supporting device comprises a hollow rod, at least two supporting elements, and an attachment device for connecting the supporting elements to the hollow rod, wherein the attachment device comprises a housing, wherein in the housing it is mounted a single lead-through opening for each supporting element where a fastening bolt is inserted therethrough, wherein a spring is mounted around each fastening bolt between a first spring limiter at a first end of the fastening bolt and a second spring limiter at a second end of the fastening bolt, wherein a first end of the supporting element is rotatably mounted to one of the first and second ends of the fastening bolt, such that each supporting element is independently sprung, and wherein the supporting device is constructed to enable the supporting elements to be positioned in the following positions:

a first, retracted position where the supporting elements are at least partly mounted inside the hollow rod, a second, extended position wherein the first end of each supporting element forms a proximal end relative to a central longitudinal axis of the hollow rod, and wherein the second end of each supporting element forms a distal end at a distance out from the central longitudinal axis of the hollow rod and wherein the supporting elements are loaded by the cloth element when the supporting elements are in the second position, and a third position between the first and the second positions, where the supporting elements are not loaded by the cloth element.

2. A supporting device according to patent claim 1, wherein the attachment device is slidingly mounted inside the hollow rod.

3. A supporting device according to patent claim 1, wherein the first spring limiter is common to several fastening bolts and supporting elements.

4. A supporting device according to patent claim 3, wherein the first spring limiter is composed of the housing.

5. A supporting device according to patent claim 1, wherein one of the first and second ends of the fastening bolt is a U-shaped slot, wherein the supporting element is rotatably mounted in the slot in the U-shaped end.

6. A supporting device according to patent claim 1, wherein the hollow rod has an oval cross section.

7. A supporting device according to patent claim 1, wherein the hollow rod is a telescopic rod that can be varied in length.

8. A supporting device according to patent claim 1, wherein a plurality of cut-outs are provided at the first end of the hollow rod, each cut-out adapted to receive a single supporting element.

* * * * *